United States Patent [19]

Plozner

[11] 4,025,288

[45] May 24, 1977

[54] GAS LAMP IGNITER DEVICE

[75] Inventor: Lisio Plozner, Via Villanova di Sotto 4, Pordenone, Italy

[73] Assignee: Elpinvest S.A., Mauren, Liechtenstein

[22] Filed: Mar. 8, 1976

[21] Appl. No.: 664,722

[30] Foreign Application Priority Data

Mar. 6, 1975 Italy ..... 67573/75

[52] U.S. Cl. ..... 431/255; 431/110

[51] Int. Cl.[2] ..... F23Q 2/28

[58] Field of Search ..... 431/100, 109, 110, 254, 431/255, 256, 266

[56] References Cited

UNITED STATES PATENTS

| | | | |
|---|---|---|---|
| 3,843,311 | 10/1974 | Nelson | 431/109 |
| 3,883,288 | 5/1975 | Berlincourt et al. | 431/109 |

FOREIGN PATENTS OR APPLICATIONS

| | | | |
|---|---|---|---|
| 1,322,898 | 7/1973 | United Kingdom | 431/109 |

*Primary Examiner*—Edward G. Favors
*Attorney, Agent, or Firm*—Sughrue, Rothwell, Mion, Zinn & Macpeak

[57] ABSTRACT

An igniter device for a gas lamp of the type having a main mantle burner and a main control valve operated by a control lever, is provided with an auxiliary valve controlling the gas flow to an auxiliary burner the flame from which is directed onto the mantle to ignite this when fed with gas. The main control lever is connected to a piezo-electric spark generator which is operated by the lever to generate sparks as the main valve is moved to a fully open position. The auxiliary valve is also linked to the main control lever so as to be opened just as or just before the piezo-electric spark generator is operated whereby ignition of the auxiliary burner and hence the main burner is effected by the single operation of the main control lever to fully open the main flow control valve. The construction includes means for ensuring that the auxiliary valve is closed when the main control lever is released.

9 Claims, 11 Drawing Figures

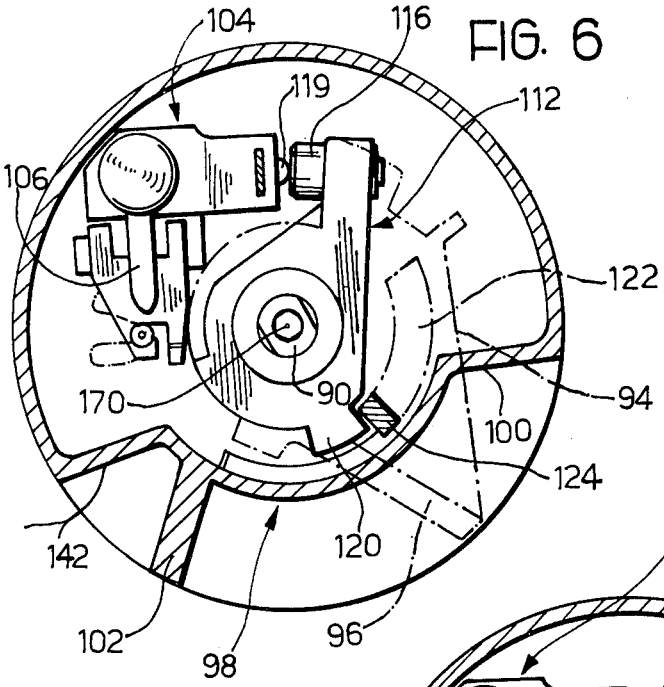
FIG. 6
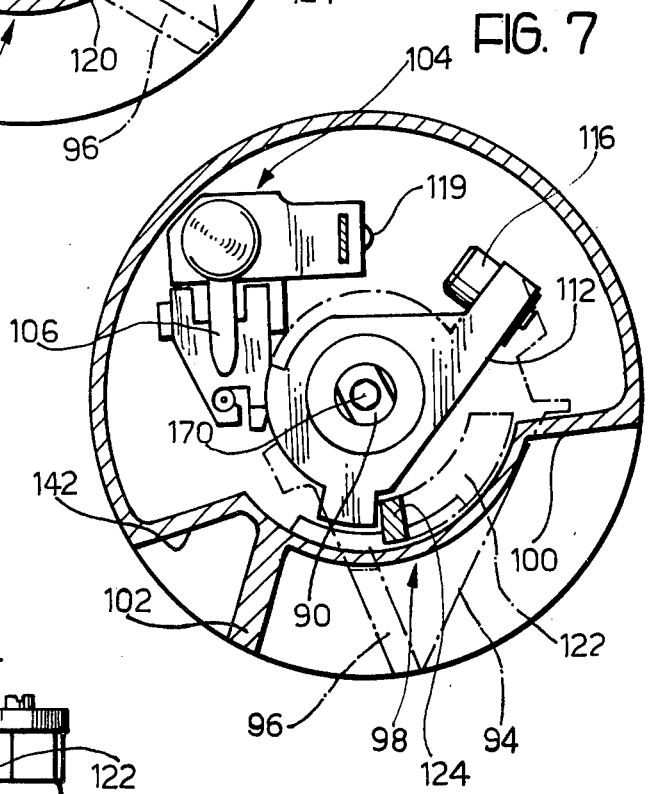
FIG. 7
FIG. 8
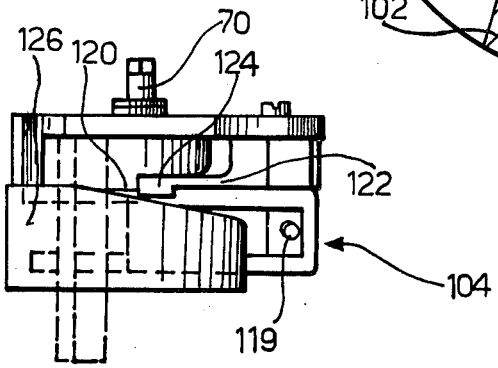

GAS LAMP IGNITER DEVICE

The present invention relates to a gas lamp igniter device, and particularly to a device for igniting gas lamps of the type having a main mantle burner, comprising a main control valve for controlling the gas flow to the main burner, this valve having a shaft turnable between a first limit position in which the valve is fully closed and a second limit position in which the valve is fully open, and manually operable main control means also movable between first and second end positions for moving the said valve shaft to any selected position between said first and second positions thereof, an auxiliary burner for igniting the main burner, the auxiliary burner having a nozzle directed towards the mantle of the main burner of the lamp, an auxiliary valve for controlling the flow of gas to the auxiliary burner, a piezo-electric spark generator having a pair of spaced electrodes positioned adjacent the auxiliary burner such that sparks generated in the space between the electrodes will ignite the stream of gas emitted by the auxiliary burner when the auxiliary valve is open, and means linked to the main valve and operable mechanically to actuate the piezo-electric spark generator when the main valve is in the fully open position. Embodiments of the present invention are particularly useful for use on portable gas lamps but are by no means restricted to such use.

Various constructions of this general type are known in the prior art. For example French Pat. No. 2,117,573, corresponding to U.S. patent application Ser. No. 96,324, in the name Berlincourt and Schweitzer, discloses a device in which the lighting of a lamp is obtained by means of sparks made to strike between two electrodes fed by a high voltage generator which, in turn, is actuated by a manual element. In this device the electrodes are located within the mantle and directly ignite the gas fed to the mantle itself. In other known devices the electrodes are located outside the mantle and in its immediate vicinity, again for the purpose of directly igniting the gas fed to the mantle.

The main disadvantage of these devices lies in the excessive proximity of the electrodes to the mantle whose temperature, when the lamp is operating, is of the order of 1000° C. Because of this very high temperature the electrodes rapidly deteriorate and become unserviceable.

Attempts have been made to eliminate this disadvantage by mounting the electrodes on a movable element by means of which they can be moved to a position close to the mantle so as to cause ignition of the lamp, and then moved back to a position spaced from the mantle so that they are spaced away from the high temperature of the latter. However, this construction too, has various disadvantages; particularly in the case of portable gas lamps, the operation of such an igniter device is complicated and requires a considerable manual dexterity.

French published patent application No. 2,181,848 discloses a device for lighting a gas heating appliance which makes it possible to effect the ignition of the appliance by means of only one control lever which simultaneously actuates, a piezo-electric spark generator and a gas flow control valve which feeds both the main burner of the apparatus and an ignition pilot burner. The piezo-electric spark generator is electrically connected to a pair of electrodes associated with the pilot burner and the spark which strikes between these electrodes as a result of the actuation of the piezo-electric spark generator ignites a small pilot flame which, in turn, ignites the gas fed to the main burner. Once ignition has been effected, because the pilot burner is fed by the same valve which feeds the main burner, the small pilot flame remains alight all the time the apparatus is in operation since the gas also continues to flow through the pilot burner. In the device described in French application No. 2,181,848, the operation of the piezo-electric spark generator, which is of the percussion type, is effected from the control lever, by means of a mechanical escapement.

In German patent application DT-OS No. 1,908,600 a gas water-heater is described, in which the ignition of a pilot flame is achieved by means of a pair of electrodes connected to a percussion type piezo-electric spark generator actuated through an escapement system by the knob of the gas feed control valve.

The igniter devices described in the above-mentioned French Pat. No. 2,181,848 and German patent application No. 1,908,600 could partly solve the problem of providing a simple and convenient ignition system for a gas lamp, particularly a gas lamp of the portable type, since it is possible with such devices to effect the ignition of the gas fed to the mantle by means of an auxiliary burner located at a position spaced from the mantle, provided the flame from this auxiliary burner is sufficiently long to reach the vicinity of the mantle. The electrodes of a piezo-electric spark generator for lighting the auxiliary burner would also be spaced from the mantle and consequently, would not be subject to damage by the high temperature of the mantle.

However, an auxiliary burner directly fed as in the above-mentioned systems by the main gas flow control valve which controls the flow of gas to the mantle of the main burner, would continue to consume gas for the whole time the lamp is alight, thereby wasting gas which is not producing light and which is also heating the spark generating electrodes thereby causing a certain deterioration of these. Such a waste of gas, in a portable lamp, or any lamp fed by a small gas cartridge, is obviously totally unacceptable, and the continuous presence of a pilot flame is both undesirable and unnecessary. In the case of gas heating appliances such as a water-heater or stove safety requirements are laid down as requiring a continuous pilot flame to prevent inadvertent large scale discharge of gas to the atmosphere.

Although an independent auxiliary control valve for the auxiliary burner could be provided the requirement for separate control actions to open this prior to lighting the lamp and close it once the lamp was lit, would cancel out the advantage provided by the simultanieous operation of the main gas flow valve and the piezo-electric spark generator when lighting the lamp.

The technical problem which the present invention seeks to solve, therefore, is that of providing an igniter device, having a piezo-electric spark generator, which is particularly suitable for portable lamps, which can be operated by means of a single very simple manual operation, but which does not have the disadvantage of the ignition electrodes of the piezo-electric spark generator being in close proximity to the mantle, nor the disadvantage of a constant waste of gas through an auxiliary burner which is open at all times when the main gas flow control valve is open.

According to the present invention, there is provided an igniter device for a gas lamp of the type having a main mantle burner, comprising a main control valve for controlling the gas flow to the main burner, this valve having a shaft turnable between a first limit position in which the valve is fully closed and a second limit position in which the valve is fully open, and manually operable main control means also movable between first and second end positions for moving the said valve shaft to any selected position between said first and second positions thereof, an auxiliary burner for igniting the main burner, the auxiliary burner having a nozzle directed, when the device is assembled on a lamp, towards the mantle of the main burner of the lamp, an auxiliary valve for controlling the flow of gas to the auxiliary burner, a piezo-electric spark generator having a pair of spaced electrodes positioned adjacent the auxiliary burner such that sparks generated in the space between the electrodes will ignite the stream of gas emitted by the auxiliary burner when the auxiliary valve is open, and means linked to the main valve and operable mechanically to actuate the piezo-electric spark generator when the main valve is in the fully open position, characterised in that the auxiliary valve is provided with resilient biasing means for urging it to its closed position, in that the auxiliary valve communicates with a gas conduit extending between the main valve and the main burner, and in that the auxiliary valve is provided with a displaceable control element for controlling its opening, this control element being linkied to the said main control means for controlling the main valve so that operation of said main control means to move the main valve to the fully open position causes the said auxiliary valve also to open, and when the said main control means are released after fully opening the main control valve, the said auxiliary valve is returned to the closed position by the said resilient biasing means.

The use of the igniter device of the invention is extrememly simple, because it requires only a single operation to cause the opening of the main control valve which feeds gas to the main burner, the simultaneous and temporary opening of the auxiliary valve resulting in a flow of gas to the auxiliary burner, and the actuation of the piezo-electric spark generator to produce a spark or a plurality of sparks which ignites the auxiliary burner, the flame from which ignites the gas at the main burner. At the end of this sequence of operations, which takes place substantially simultaneously, when the user has noted that the lamp is alight it is sufficient for him to release the manual control element to terminate the supply of gas to the auxiliary burner. Subsequently the manual control element can be adjusted towards the "closed" direction to regulate the light intensity of the lamp.

One embodiment of the invention will now be more particularly described, by way of example, with reference to the accompanying drawings, in which:

FIG. 6 is a plan view from above of the ignition device in the rest position;

FIG. 7 is a plan view similar to FIG. 6, in which the component parts are shown in the positions they adopt in an intermediate stage of an ignition operation;

FIG. 8 is a side view of the device, with the parts shown in the same positions as in FIG. 7.

Figure 1:
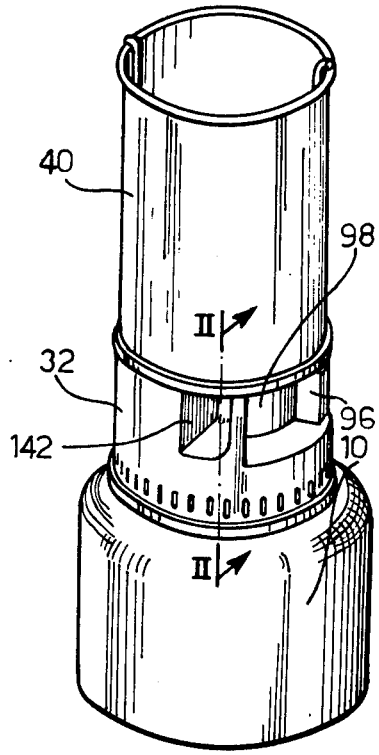
FIG. 1 is a perspective view of a portable gas lamp provided with an igniter device made as an embodiment of the invention.
Figure 2:
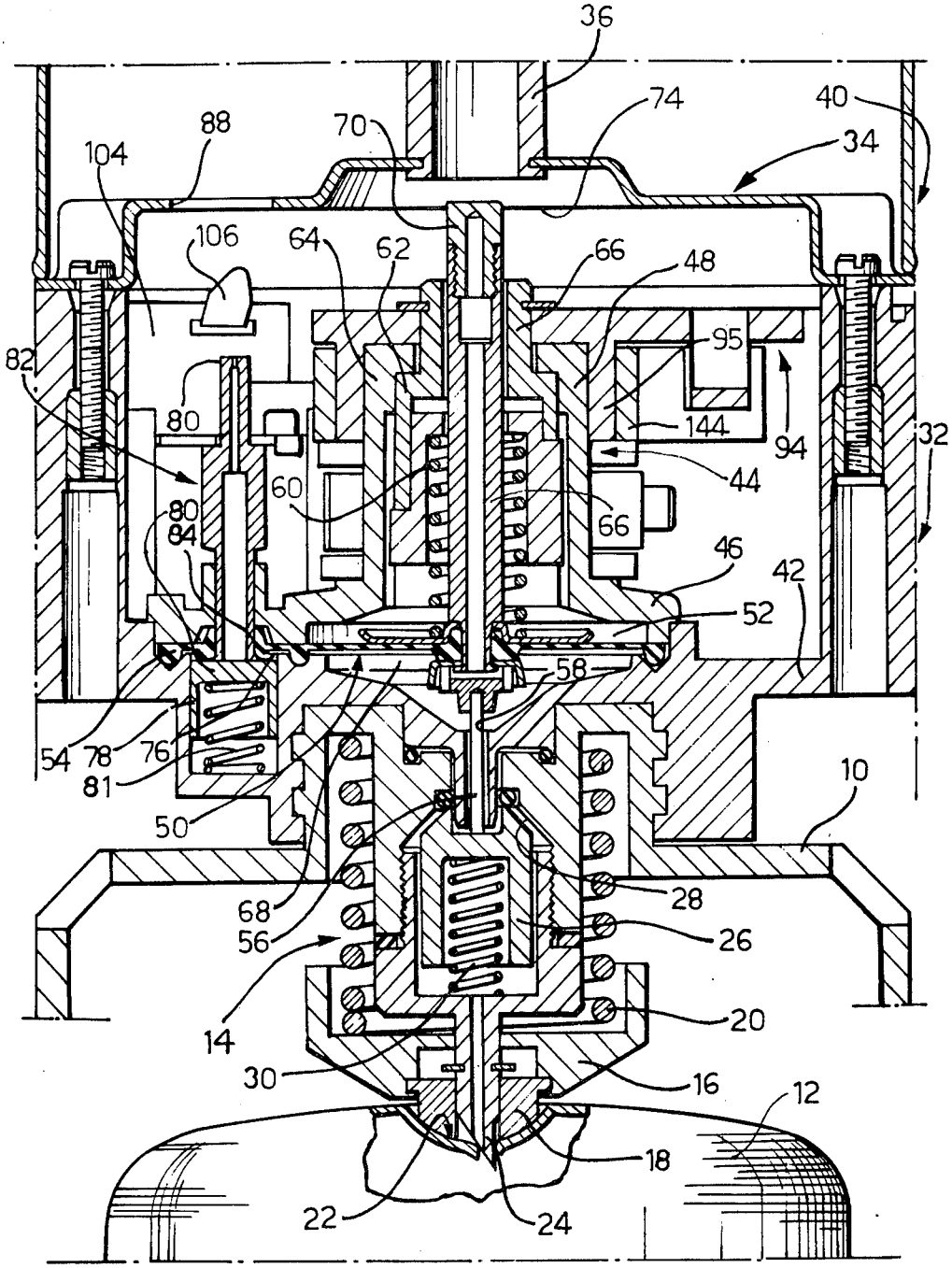
FIG. 2 is a partly sectioned side view of the embodiment of FIG. 1.

Referring now to the drawings, FIGS. 1 and 2 show a typical arrangment of a portable gas lamp with an igniter device formed as a preferred embodiment of the invention.

In the following description reference will be made for convenience to the lamp in a normal upright orientation on a flat horizontal surface, terms such as "lower", "upper", and the like will be construed accordingly with the lamp in this position.

The lamp illustrated comprises a hollow base 10 in which can be mounted a removable cartridge 12 containing liquefied gas. The cartridge is of a known type in the form of a cylinder with a domed top having a central recess. In the upper part of the body 10 is mounted a valve unit 14 having a spring retainer 16 provided with an annular seal 18 which by means of a compression spring 20 acting on the retainer cap 16 is kept firmly pressed onto the recess 22 centrally formed in the top of the cartridge 12. Through the annular seal 18 extends a hollow needle 24 with a sharp point which penetrates within the cartridge 12 for withdrawing the gas.

The valve unit 14 also includes a valve body 26 which is normally kept engaged with a valve seat 28 by a compression spring 30. The valve body 26 and valve seat 28 constitute a main valve which forms part of the igniter device of the invention.

On the base 10 is fixed a substantially cylindrical hollow support body 32 in which, as will be described more fully below, are mounted the components of the igniter device of the invention, apart from the main valve.

Figure 3:
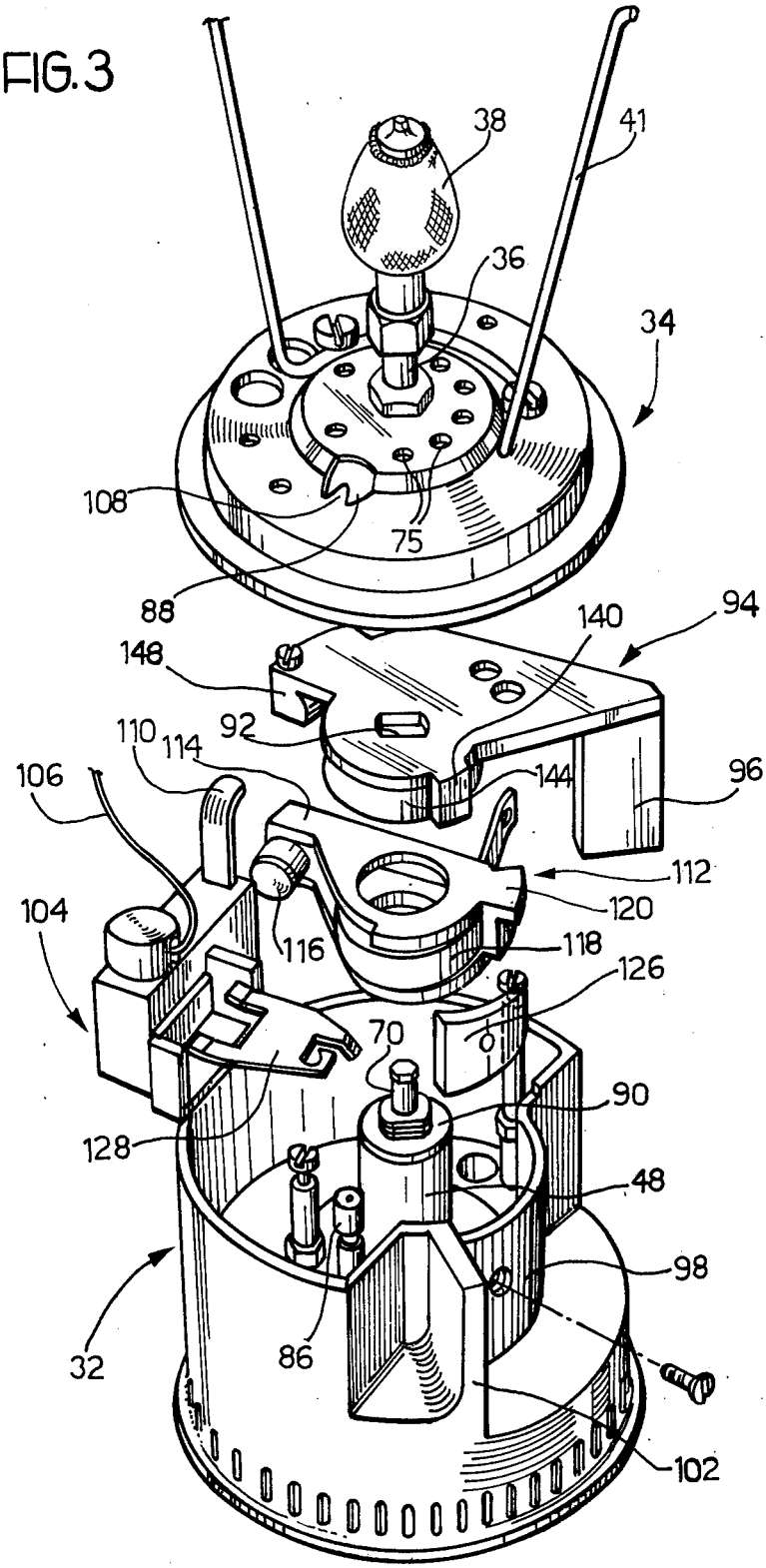
FIG. 3 is an exploded perspective view of the component parts of the embodiment of the invention and the co-operating parts of the lamp shown in FIG. 2.

With particular reference to FIGS. 1, 2 and 3, on the support body 32 is mounted a circular plate 34 which carries a central tubular stem 36 on which is fixed a mantle 38. Surrounding this assembly and supported by the plate 34 is a frosted glass lamp-shade 40, held in position on the plate 34 by means of a bracket 41 made of metal wire.

As will be seen from FIG. 2, the support body 32 has a lower transverse wall 42 on which is centrally fixed a cap 44 which comprises a widened base part 46 and an upwardly directed tubular part 48. Between the base part 46 and the transverse wall 42 is enclosed a gasket 50 having a side-by-side double annular form like a number '8' with a larger annular part 52 and a smaller annular part 54. The larger annular part 52 is in the form of an annular diaphragm situated in a cavity defined by the transverse wall 42 and the base part 46 of the cap 44. The lower side of the diaphragm 52 is provided with a pin element 56 which, with clearance, goes through a hole 58 in the transverse wall 42 and which engages the valve body 26. Against the upper side of the membrane 52 there presses the lower end of a helical compression spring 60 the other end of which presses against an upper flange of a bush 62 mounted so as to be axially slidable but not reotatable, within the tubular part 48 of the cap 44. The bush 62 is formed externally with a long pitch screw thread with which co-operates a complementary internal thread formed in an axial bore in a sleeve 64 which is an axial extension of a further sleeve 66. The sleeve 64 is mounted for rotation but is restrained from sliding axially of the tubular part 48 of the cap 44. Coaxially within this assembly extends a narrow tube 67 which passes through the diaphragm 52 so that its interior communicates with a chamber 68 defined, beneath the diaphragm 52, between the lower face of the diaphragm 52 itself and the transverse wall 42. The other end of the tube 67 is formed with a calibrated nozzle 70 which is directed towards the open lower end of the tubular stem 36. The tube 67 thus serves as a gas flow conduit between the main valve 26, 28 and the burner nozzle 70.

As will be appreciated, a rotation of the sleeve 64 produces an axial movement of the bush 62 to compress or release the compression of the spring 60 and flex the diaphragm 52. Flexure of the diaphragm 52 produces, in turn, an axial displacement of the needle element 56 and the valve body 26, and therefore selective rotation of the sleeve 64 causes a selective opening of the main valve constituted by the valve body 26 and the valve seat 28. The diaphragm 52 operates as a pressure regulator because the gas pressure in the chamber 68 opposes the action of the spring 60 and therefore tends to reduce the flexure of the diaphragm 52. The advantages of this pressure regulator will be discussed in greater detail below.

The nozzle 70 thus acts to feed gas into the stem 36. Bacause there is a space between the nozzle 70 and the entrance to the stem 36 the mantle 38 is fed, in the conventional manner, with a mixture of the gas delivered by the nozzle 70 and air drawn from a space 74 under the annular plate 34, this air entering the space 74 through a multiplicity of holes (FIG. 3) in the plate itself.

Communicating with the chamber 68, there is a lateral passage 76 in the transverse wall 42, which leads to an axial cylindrical cavity 78, formed in the wall itself and housing a valve body 80 in the form of a bowl which is normally pressed by a spring 81 against an annular valve seat 84 formed by the smaller annular part 54 of the gasket 50. In the base part 46 of the cap 44 there is slidably mounted a hollow tube 82 which extends upwards. The interior of the hollow tube communicates, at the lower end, with the axial cylindrical cavity 78 when the valve body 80 is displaced from the valve seat 84. The upper end of the hollow tube 82 is formed with a calibrated nozzle 86. This nozzle 86, as will be more fully described below, constitutes an auxiliary burner for producing a flame of sufficient length to reach the region immediately adjacent the mantle 38. This flame passes through an aperture 88 in the circular plate 34, which aperture is located directly above the nozzle 86.

The hollow tube 82 abuts the valve body 80 so that downward displacement of the tube 82 opens the valve constituted by the valve body 80 and valve seat 84, which is normally closed by the spring 81, to allow gas from a position downstream of the main control valve 26, 28 to be fed to the auxiliary burner constituted by the nozzle 86.

The sleeve 66 for the control of the main valve 26, 28 has a prismatic keying part 90 over which fits a control lever 94 having an aperture 92 of form corresponding to that of the prismatic keying part 90. The lever 94 has a tubular boss 95 by means of which it is rotatably mounted on the tubular part 48 of the cap 44 and is provided at its radially outer end with a tab 96 which is movable along an arc in an arcuate recess 98 in the peripheral wall of the support body 32.

The cooperating screw threads on the bush 62 and sleeve 64 are such that clockwise movement of the lever 94 (as seen from above) causes progressive opening of the main valve 26, 28 and, correspondingly, anti-clockwise movement causes a progressive closing of the valve 26, 28. The angular displacement of the lever 94 is limited by two radial walls 100, 102 defining the ends of the arcuate recess 98 in the peripheral wall of the support body 32. When the tab 96 is disposed against or closely adjacent the radial wall part 100 (FIGS. 6, 7, and 10) of the peripheral wall of the body 32, at the limit of the anti-clockwise movement of the lever 94, the main valve 26, 28 is fully closed, and when the tab 96 is disposed against or closely adjacent to the radial wall part 102 of the peripheral wall of the support body 32 the main valve 26, 28 is fully open.

Within the support body 32 is fixed a percussion type piezo-electric spark generator 104 which carries an electrode 106 in the form of a blade, located closely adjacent to the path of gas flowing from the nozzle 86 constituting the auxiliary burner. The other electrode of the piezo-electric spark generator 104 is a tongue 108 which is a part of the circular plate 34, and is provided by forming the aperture 88, through which the gas from the nozzle 86 flows, to have a substantially C-shape. The connection of the electrode 108 with the piezo-electric generator 104 is obtained, through the metal of the plate 34, by means of a contact blade 110 rigidly attached to the piezo-electric spark generator 104 and against which the lower face of the plate 34 is kept engaged.

For the purpose of actuating the piezo-electric spark generator 104, there is rotatably mounted on the tubular part 48 of the cap 44, coaxial to the sleeve 64 a striker body 112 which has a substantially radial striker arm 114 on which is fixed a striker element 116. Attached to the striker body 112 is one end of a spiral spring 118 the other end of which is engaged against a fixed abutment (not shown) in the support body 32. the spring 118 is such that it urges the striker body 112 in an anti-clockwise direction (as seen in plan), to a position in which the striker 116 is disposed against a percussion boss 119 (see FIG. 6) of the piezo-electric spark generator 104.

The striker body 112 has a substantially radial projection 120 extending opposite the radial arm 114, which acts as an abutment element.

Figure 11:
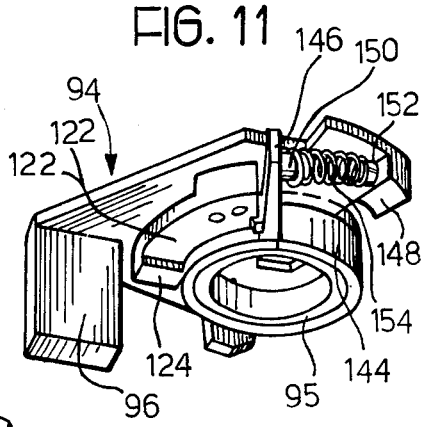
FIG. 11 is a perspective view of a detail of the embodiment illustrated in FIGS. 1 to 10.

A curved resilient strip 122 (see FIG. 11) is secured to the lever 94. This strip is fixed to the lever element 94 by one end, which is the trailing end with respect to the direction of rotation of the lever 94 corresponding to the opening of the main valve. The other end of the strip 122 is enlarged in such a manner as to form an abutment element 124 for co-operating with the abutment element 120 of the striker body 112 carrying the striker 116.

Thus when the lever 94 turns in the direction which causes opening of the main valve, the abutment element 124 of the resilient strip 122 comes into engagement with the abutment element 120 of the striker body 112 and turns this, against the force of the spring 118, moving the striker 116 away from the percussion boss 119 of the piezo-electric generator 104.

Inside the peripheral wall of the support body 32, in correspondence with the recess 98, is fixed a ramp 126 so disposed that it is engaged by the abutment element 124 of the resilient strip 122 in the course of the movement of the lever 94 corresponding to opening the main valve. The strip 122 engages the ramp 126 and is progressively deformed upwardly by this engagement until the abutment element 124 of the strip 122 is disengaged from the abutment element 120 of the striker body 112 allowing the latter to snap back to its starting position under the action of the spring 118 until the striker 116 strikes the percussion boss 119 resulting in a generation of sparks between the electrodes 106 and 108.

Because the generation of the sparks must correspond with the delivery of gas from the nozzle 86 of the auxiliary burner, the latter is provided with an element for controlling the opening of the auxiliary valve 80, 84. This element is in the form of an arm 128 which is pivoted about an axis which extends radially with respect to the axis of rotation of the lever 94. The arm 128 is pivotally mounted in a bracket 130 fixed to the support body 32, and has a bifurcated end 132 which engages a collar 134 of the hollow tube 82 of the auxiliary burner in such a way that a downward displacement of the arm 128 causes a lowering of the tube 82 and the consequent opening of the auxiliary valve 80, 84.

In order to cause such downward displacement of the arm 128 this is provided with an inclined ramp surface 136 which is engaged by a cooperating opposite ramp surface 138 on the lower edge of a tab 140 formed on the lever 94. The position of the tab 140 is such that the ramp 138 thereon engages the ramp 136 of the arm 128 and causes lowering of the arm 128, and therefore of the tube 82, against the force of the spring 81, as the lever 94 is moved towards the position corresponding to full opening of the main valve, when the lever 94 is in close proximity to the radial part of the wall 102, at or just before the moment when the sparks are struck between the two electrodes 106 and 108.

Figure 5:
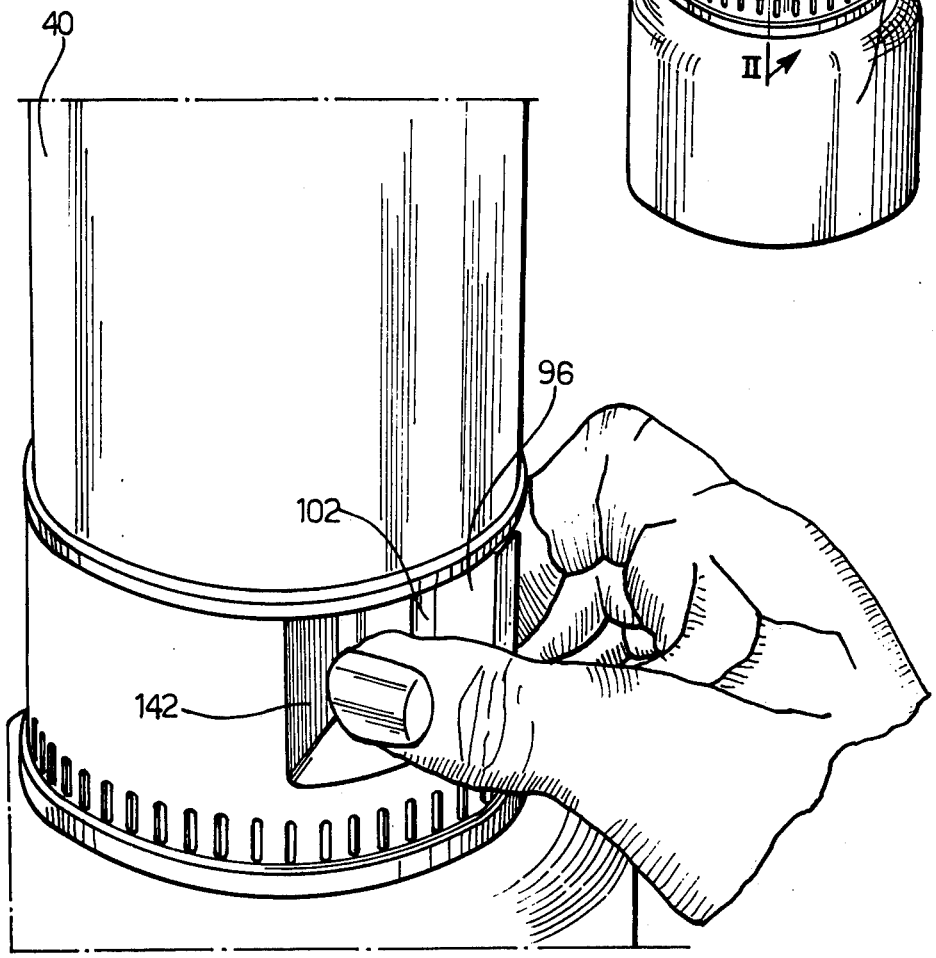
FIG. 5 is a perspective view of a part of the lamp shown in FIG. 1, illustrating the manual igniting operation.

In the embodiment illustrated the lever 94 can be turned, by means of the tab 96, by using only one hand and for this purpose, the peripheral wall of the support body 32 is provided with a supplementary recess 142. As illustrated in FIG. 5, by engaging the thumb of the right hand in the recess 142 and engaging the tab 96 with the index finger of the same hand it is very easy to effect the required movement of the lever 94 to obtain a complete opening movement of the main valve, from the fully closed position to the fully open position, merely by moving the thumb and index finger of the right hand together. A left-handed person can effect the same operation by engaging the index finger of the left hand in the recess 142 and the thumb of the left hand against the tab 96.

Figure 4:
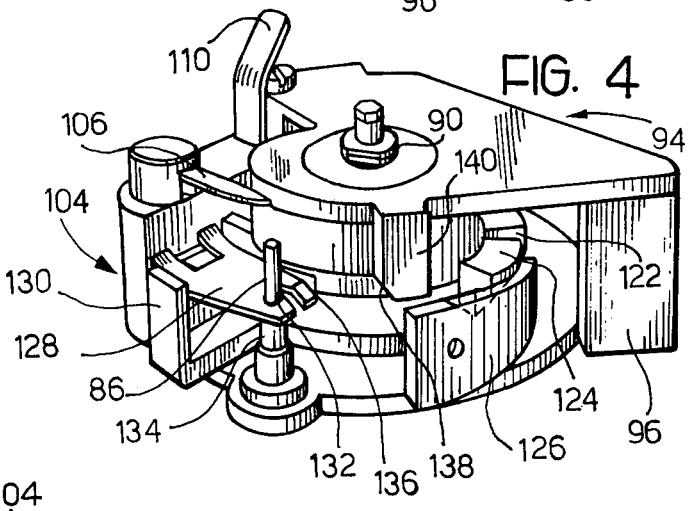
FIG. 4 is a perspective view of the main parts of the igniter device, shown assembled together.
Figure 10:
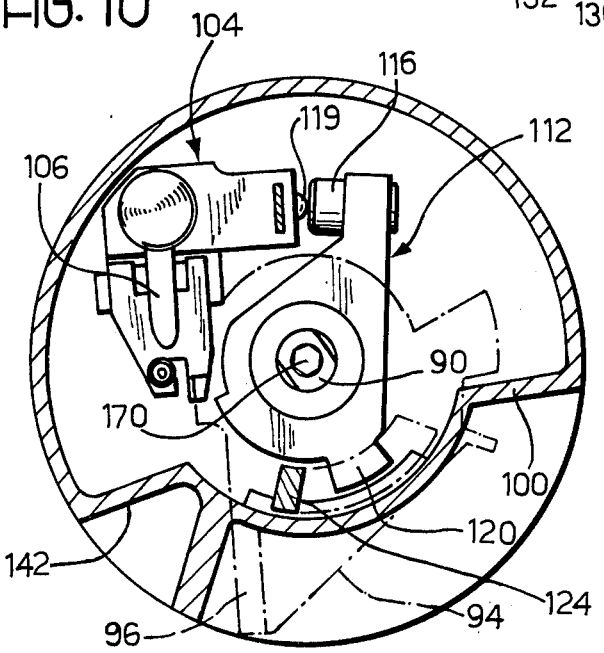
FIG. 10 is a view similar to FIG. 6 and FIG. 7, but in which the component parts of the device are shown in the positions they adopt in the final stage of an ignition operation.

With reference to FIGS. 6 and 10 the operation of the igniter device will now be described in greater detail. The device is initially in a rest position, to which it is biased by the various springs, in which the main valve is closed (the tab 96 abutting against the wall part 100 or in close priximity thereto), and in which the striker 116 is resting against the percussion boss 119 of the piezo-electric spark generator 104. In this rest position the auxiliary valve is closed since the pivoted arm 128 is not engaged by the tab 140 which, as shown in FIG. 4, is spaced therefrom.

Figure 9:
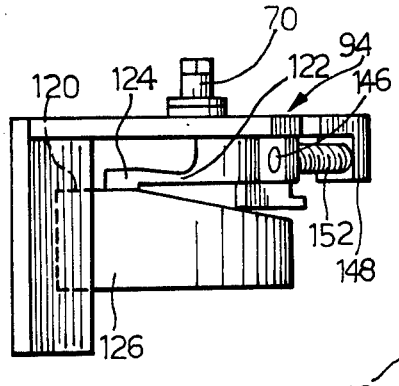
FIG. 9 is a side view similar to FIG. 8, but showing the positions the component parts adopt in a more advanced stage of an ignition operation.

To ignite the lamp the user places the fingers as in FIG. 5 and presses the tab 96 towards the left (as seen in FIG. 5) thereby turning the lever 94 clockwise (as viewed from above). This moves the abutment element 124 of the resilient strip 122 so as to engage the cooperating abutment element 120 of the striker body 112. The components of the device are illustrated in this position in FIG. 6. As rotation of the lever 94 in the same direction continues the main valve 26, 28 is progressively opened and the abutment element 124 of the curved resilient strip 122 engages the ramp 126 (FIG. 8) and the strip 122 is progressively deformed upwardly thereby. At the same time the striker body is turned in the same direction of rotation as the lever 94 by the engagement between the abutment element 124 on the curved strip 122 and the abutment element 120 projecting from the striker body 112 itself so that the striker progressively moves away from the percussion boss 119, of the piezo-electric spark generator. The components of the device are illustrated in this imtermediate position in FIG. 7. When the abutment element 124 reaches a certain point along the ramp 126 it becomes disengaged from the abutment element 120 and the striker body 112 is released to be snapped back to its starting position by the spring 118 so that the striker 116 is driven sharply against the percussion boss 119 to cause the generation by the piezo-electric spark generator of sparks between the electrodes 106 and 108. This is illustrated in FIGS. 9 and 10 and occurs at substantially the same time as the main valve becomes fully open.

Meanwhile, the ramp surface 138 of the tab 140 has engaged the ramp surface 136 of the pivoted arm 128 and has caused the arm to be depressed thereby lowering the tube 82, and consequently opening the auxiliary valve 80, 84, against the action of the spring 81, whereby the nozzle 86 of the auxiliary burner emits a jet of gas just as or just before the striker body is released. The jet of gas from the nozzle 86 passes through the opening 88 in the plate 34 defining one of the electrodes 108 and is thus ignited by the sparks. The nozzle of the auxiliary burner 86 is so calibrated that the flame obtained is long enough to reach and play on the mantle 38 to ignite the gas fed to it through, the now open, main valve 26, 28.

After ignition has taken place, the user usually moves back the lever 94 by a small distance to cause a slight closure of the main valve 26, 28 in order to regulate the amount of gas which passes through the main valve 26, 28 and thus to regulate the light intensity and gas consumption of the lamp. With this operation, the tap 140 is moved away from the pivoted arm 128 and the auxiliary valve 80, 84 is closed by the effect of the spring 81 (FIG. 2); the auxiliary flame is thus extinguished and there is no subsequent wastage of gas by the auxiliary burner.

In fact, the force of the spring 81 may be sufficient to cause the lever 94 to move back, by the engagement of the two ramp surfaces or inclined planes 136, 138 to allow the auxiliary valve 80, 84 to shut. However, in order to make quite sure that this valve is shut the igniter device is provided with a collar 144 (FIG. 11) mounted for rotation around the annular boss 95 of the lever 94 and having a radial arm 146. The lever 94 has a shoulder 148 disposed on the far side of the arm 146 from the tab 96. The arm 146 and the shoulder 148 both have respective bosses 150 and 152 facing one another onto which bosses is fixedly mounted a helical compression spring 154 which connects the lever 94 and the collar 144 together so that when the lever 94 is turned the collar 144 turns in the same direction. The arm 146 is so positioned that it abuts against the radial wall 100 shortly before the lever 94 reaches the position corresponding to the full opening of the main valve 26, 28. In the last part of the movement of the lever 94 the arm 146 is pressed against the wall 100 and the spring 154 is compressed thereby exerting against the shoulder 148 a force which urges the lever 94 to move back a certain distance from its end position corresponding to maximum opening of the main valve 26, 28, so that the auxiliary valve is allowed to close when the user releases the tab 96, without requiring a conscious movement of the tab 96 back from the end position therof in which the auxiliary valve 80, 84 is open.

In order to extinguish the lamp when it is no longer required it is only necessary to move the lever 94 back to its initial position. Shortly before the initial position is reached, the abutment element 124 of the resilient strip 122 rides over the abutment element 120 of the striker body 112 and moves back to its originaal position in which it is again ready to engage the abutment element 120 of the striker body 112 to turn this latter as the lever 94 is turned to open the main valve 26, 28.

In an ignition device according to the invention, the presence of a pressure regulator such as that provided by the diaphragm 52 is advantageous for two reasons: in the first place a pressure regulator ensures, for all positions of the main valve 26, 28, substantial constancy of the pressure of the gas fed to the mantle burner, and therefore, of the light intensity, substantially independently of the amount of gas remaining in the cartridge 12; in the second place independently of the quantity of gas contained in the cartridge 12 the flow of gas fed to the auxiliary burner 68 always remains substantially the same, and if by a suitable selection of the size of the auxiliary burner this flow is optimum when the cartridge 12 is full, it will remain substantially the same when the cartridge 12 is almost empty. In this way, for the whole duration of the cartridge 12, an adequately long ignition flame is ensured for secure ignition of the lamp.

The concentric arrangement of the various parts of the igniter device described in relation to the preferred embodiment illustrated in the accompanying drawings, with respect to the axis of the sleeve 64 and the nozzle 70 (which is the central axis of the lamp) makes possible a very compact construction of small dimensions, so that a portable lamp provided with the igniter device of the present invention can have overall dimensions substantially the same as those of conventional portable lamps of this type.

Embodiments of the invention can be manufactured economically since many of the parts can be made of plastics material, including the moving parts which may be made of a self-lubricating material, resistant to wear, such as a polyamide or a polytetrafluoroethylene.

The present invention is not limited in application to portable gas lamps provided with an incorporated gas cylinder or bottle, and may with advantage be used on either portable or fixed lamps which are fed by means of a pipe system from a separate source of gas, such as a bottle or a permanent distribution network.

I claim:

1. In a gas lamp of the type having a main mantle burner, mounted on a support structure therefor, an igniter device comprising:

a main valve controlling the flow of gas along a conduit leading to said main burner, said main valve having a shaft with manually operable main control means by which said shaft is turnable about its own axis between first and second limit positions respectively defining the fully closed and the fully open positions of said main valve, an auxiliary burner for the ignition of the main burner, said auxiliary burner having a nozzle directed towards said mantle of said main burner of said lamp, an auxiliary valve for controlling the flow of gas to said auxiliary burner, means connecting said conduit between said main valve and said main burner to said auxiliary valve, resilient biasing means for biasing said auxiliary valve to its closed position, an auxiliary control element controlling the opening of said auxiliary valve, a piezoelectric spark generator having a pair of electrodes between which a spark is generated upon operation of said piezoelectric spark generator, said electrodes being positioned adjacent said auxiliary burner whereby to ignite this upon the generation of sparks between said two electrodes, mechanical actuator means for operating said piezoelectric spark generator when said main valve is in the fully open position, and means interconnecting said main control means of said main valve, said mechanical actuator means of said piezoelectric spark generator, and said auxiliary control element controlling said auxiliary valve, whereby operation of said main control element to move said main valve to the fully open position thereof also causes said auxiliary valve to be opened and said piezoelectric spark generator to be operated to ignite said auxiliary burner which in turn ignites said main burner, said auxiliary valve closing when said main control means are released.

2. An igniter device as in claim 1, wherein said main control means comprises a lever provided with a projection, said projection engaging against said displaceable element of said auxiliary valve as said lever approaches said second position thereof whereby to cause displacement of said control element, against the action of said resilient biasing means of said auxiliary valve, to open said auxiliary valve as said main control valve is moved to its fully open position.

3. An igniter device as in claim 2, wherein said lever element is pivotally mounted to turn about an axis coincident with that of said gas feed conduit between said main valve and said main burner, and said piezoelectric spark generator is of the percussion type having an operating member, a striker on a striker body which is also pivotally mounted coaxial with said gas feed conduit, resilient biasing means engaging said striker body and biasing it to a first position where it contacts said operating member of said piezoelectric spark generator, escapement means linking said striker body to said main control lever, said escapement means acting to turn said striker body with said lever as said lever is moved from its first to its second position, and to release said striker body as said lever reaches said second position thereof, whereupon said resilient biasing means returns said striker body to its first position to strike said operating member of said piezoelectric spark generator and thereby generate sparks.

4. An igniter device as in claim 3 wherein said auxiliary valve includes an axially displaceable tube formed with a nozzle at one end, said tube also contacting a valve plug of said valve at the other end thereof, said control element of said auxiliary valve comprising a pivoted arm, a fixed collar carried by said tube, said pivoted arm engaging said fixed collar whereby pivoting movement of said pivoted arm displaces said tube axially against the action of said resilient biasing means of said auxiliary valve to open said auxiliary valve, a first cam surface on said pivoted arm, a second cam surface on said projection of said lever, said first and second cam surfaces engaging when said lever approaches the end of its travel towards said second position thereof, in which position said main valve is fully open, whereby to cause axial displacement of said tube and open said auxiliary valve.

5. An igniter device as in claim 2, wherein there are provided resilient biasing means for urging said lever away from said second position thereof towards said first position thereof, to a position in which said projection of said lever is disengaged from said displaceable control element of said auxiliary valve.

6. An igniter device as in claim 3, wherein said mechanical escapement linking said striker body to said main control lever comprises:

a resilient arcuate strip attached at one end thereof to said lever and concentric with the pivot axis of said lever, an abutment element formed on the other end of said resilient arcuate strip, an abutment element formed on said striker body, said abutment element on said resilient arcuate strip engaging said abutment element on said striker body when said resilient arcuate strip is in an unstressed state, and a fixed ramp element against which said arcuate resilient strip engages as said lever is turned towards its second position, engagement of said resilient arcuate strip with said fixed ramp element causing progressive deflection of said resilient strip as said lever approaches the second position thereof, deflection of said resilient strip beyond a certain point causing disengagement of said abutment element at its end remote from said abutment element of said striker body allowing said resilient biasing means of said striker body to return it to its original position to strike said operating member of said piezoelectric spark generator.

7. An igniter device as in claim 6, wherein said arcuate resilient strip is deformable in a direction parallel to the axis of rotation of said lever.

8. An igniter device as in claim 2, wherein said lever is mounted in a housing, a first arcuate recess in said housing concentric with the pivot axis of said lever, in which recess the free end of said lever moves, a second recess in said housing spaced from said first recess by a radial wall positioned such that the said radial wall and the free end of said lever can be gripped by the finger and thumb of one hand to operate said igniter device.

9. An igniter device as in claim 2, wherein said main valve has an associated pressure regulator acting to regulate the pressure of gas delivered by said main valve for any given setting of said lever so as to be independent of the pressure of gas fed to said main valve.

* * * * *